US007479927B2

(12) United States Patent
Scarpelli

(10) Patent No.: US 7,479,927 B2
(45) Date of Patent: Jan. 20, 2009

(54) RADIO FREQUENCY ANTENNA SYSTEM

(75) Inventor: Tadd M. Scarpelli, Third Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 349 days.

(21) Appl. No.: 11/323,178

(22) Filed: Dec. 30, 2005

(65) Prior Publication Data

US 2007/0152888 A1 Jul. 5, 2007

(51) Int. Cl.
*H01Q 1/24* (2006.01)

(52) U.S. Cl. ..... 343/702; 343/700 MS; 343/846

(58) Field of Classification Search ..... 343/700 MS, 343/702, 829, 830, 846
See application file for complete search history.

(56) References Cited

U.S. PATENT DOCUMENTS 6,297,776 B1 * 10/2001 Pankinaho ..... 343/700 MS
6,373,442 B1 * 4/2002 Thomas et al. ..... 343/767
6,421,016 B1 * 7/2002 Phillips et al. ..... 343/702
6,940,460 B2 9/2005 Maoz et al.
7,317,421 B2 * 1/2008 Liu ..... 343/700 MS

OTHER PUBLICATIONS

DU et al., A Compact Planar Inverted-F Antenna With A PBG-Type Ground Plane For Mobile Communications, IEEE Transactions on Vehicular Technology, vol. 52, No. 3, May 2003, 483-489.

* cited by examiner

*Primary Examiner*—Tho G Phan
(74) *Attorney, Agent, or Firm*—Daniel R. Collopy; Lawrence J. Chapa

(57) ABSTRACT

An antenna system (110) for more efficient radiation and reception of radio frequency (RF) signals includes a primary conductor (302), a ground conductor (306) and one or more secondary conductors (310). The primary conductor (302) functions as a first antenna by receiving or radiating electromagnetic energy at a first set of one or more predetermined frequencies of operation. The ground conductor (306) is coupled to one end of the primary conductor (302). Each of the one or more secondary conductors (310) has a first end coupled to the ground conductor (306) near an area of higher current densities which forms when the primary conductor (302) is receiving or radiating electromagnetic energy at one of the first set of predetermined frequencies. The one or more secondary conductors (310) function to provide an additional path for any localized ground currents in the ground conductor (306) near the area of higher current densities. Also, the one or more secondary conductors (310) can function as a second antenna at a second set of one or more predetermined frequencies of operation different than the first set of predetermined frequencies.

26 Claims, 5 Drawing Sheets

RADIO FREQUENCY ANTENNA SYSTEM

FIELD OF THE INVENTION

The present invention generally relates to wireless radio frequency (RF) communication devices, and more particularly relates to antennas for wireless RF communication devices.

BACKGROUND OF THE INVENTION

Wireless radio frequency (RF) communication devices, such as cellular phones, come in several different form factors. To enable RF communication, an antenna system, typically including a primary conductor and a ground conductor, needs to be provided which will enable the appropriate RF transmission and/or reception properties for the RF communication system for which the wireless communication device is designed. The ground conductor typically includes one or more ground planes which, by their design, tune the antenna system transmit or receive RF signals on one or more predetermined frequencies. Ground currents flow through the one or more ground planes during transmission or reception of RF signals, and it is common that an area of higher current densities forms at a location on the one or more ground planes, thereby reducing the efficiency of the antenna system.

In addition, the structure of the one or more ground planes as dictated by the form factor of the wireless communication device can reduce the efficiency of the antenna system. One common form factor for wireless communication devices, such as cellular phones, is the flip phone or clamshell phone which has a base portion coupled to an upper flip portion by one or more hinges. A ground plane for such wireless communication devices is designed and tuned for the antenna system such that portions of the ground plane are typically located in both the base portion and the flip portion. During operation, the flip portion can be designed to be placed near the ear and the base portion is angled therefrom to locate a microphone therein near the mouth. While ergonomically convenient, the portions of the ground plane in this orientation are obstructed one from another by the user, thereby detuning the antenna and reducing the efficiency of the antenna system. In addition, when the flip portion is in the closed position, the effective ground plane is reduced, thereby also reducing the efficiency of the antenna system. Also, as today's wireless communication devices add more functionality, such as hands free operation, antenna systems which receive additional frequencies much higher or much lower than conventional RF signaling frequencies may be required.

Thus, what is needed is an apparatus which increases the efficiency of wireless RF communication devices' antenna system. In addition, an apparatus is needed to enable reception and/or transmission of RF signals at much higher or much lower frequencies than conventional RF signaling frequencies. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

An antenna system for more efficient radiation and reception of radio frequency (RF) signals includes a primary conductor, a ground conductor and one or more secondary conductors. The primary conductor is adapted for receiving or radiating electromagnetic energy at a first set of one or more predetermined frequencies of operation. The ground conductor is located proximate at least one end of the primary conductor and coupled thereto. Each of the one or more secondary conductors has a first end coupled to the ground conductor proximate an area of high current density when the primary conductor is receiving or radiating electromagnetic energy at least a respective one of the first set of one or more predetermined frequencies of operation. In addition, the one or more secondary conductors have at least a first mode of operation which provides an additional path for any localized ground currents in the ground conductor proximate the area of higher current densities at the respective one of the first set of one or more predetermined frequencies of operation.

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
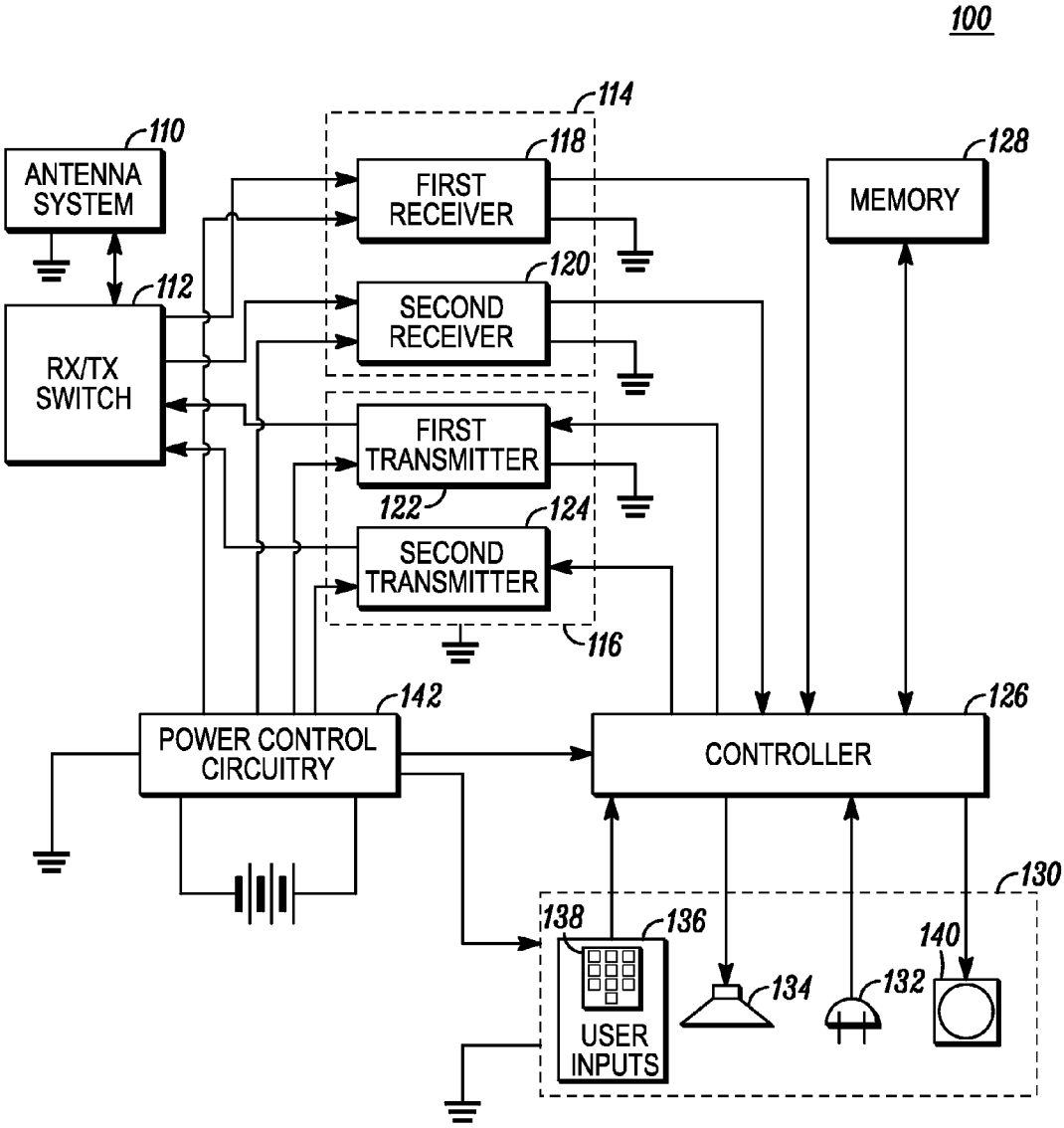
FIG. 1 is a block diagram of a wireless communication device in accordance with at least one embodiment of the present invention.

Referring to FIG. 1, a block diagram of a wireless communication device 100, such as a cellular telephone, in accordance with an embodiment of the present invention depicts the circuitry thereof. Although the wireless communication device 100 is depicted as a cellular telephone, the wireless communication device can be implemented as a pager, a laptop computer with a wireless connection, a personal digital assistant with wireless connection, or the like. The circuitry of the wireless electronic device 100 includes an antenna system 110 for receiving and transmitting RF signals. A receive/transmit switch 112 selectively couples the antenna system 110 to receiver circuitry 114 and transmitter circuitry 116 in a manner familiar to those skilled in the art. In accordance with the present invention, the antenna system 110 includes a primary conductor and a secondary conductor for receiving or radiating electromagnetic energy for operation at a first set of one or more predefined RF frequencies and a second set of one or more predefined RF frequencies, respectively (as described with FIG. 4 below). The receiver circuitry 114 includes a first receiver 118 for receiving and demodulating RF signals received on one or more of the first set of predefined RF frequencies and a second receiver 120 for receiving and demodulating RF signals received on one or more of the second set of predefined RF frequencies. The transmitter circuitry 116 includes a first transmitter 122 for modulating RF signals to be transmitted on one or more of the first set of predefined RF frequencies and a second transmitter 124 for modulating RF signals to be transmitted on one or more of the second set of predefined RF frequencies.

The receiver circuitry 114 demodulates and decodes the RF signals to derive information and is coupled to a controller 126 for providing the decoded information thereto for utilization thereby in accordance with the function(s) of the wireless communication device 100. Conversely, the controller 126 also provides information to the transmitter circuitry 116 for encoding and modulating information into RF signals for transmission from the antenna system 110. As is well-known in the art, the controller 126 is typically coupled to a memory device 128 and a user interface 130 to perform the functions of the wireless electronic device 100. The user interface 130 includes a microphone 132, a speaker 134 and one or more key inputs 136, including a keypad 138. The user interface 130 also includes a display 140 which may be designed to accept touch screen inputs.

Power control circuitry 142 is coupled to a battery 144 and defines a ground potential (hereinafter referred to as "ground") and other operational voltages for the operation of the wireless communication device 100. The power control circuitry 142 is coupled to the components of the wireless communication device 100, such as the controller 126, the receiver circuitry 114, the transmitter circuitry 116, and/or the user interface 130, to provide ground and appropriate operational voltages and currents to those components. In addition, the antenna system 120 is coupled to ground of the power control circuitry 142.

Figure 2:
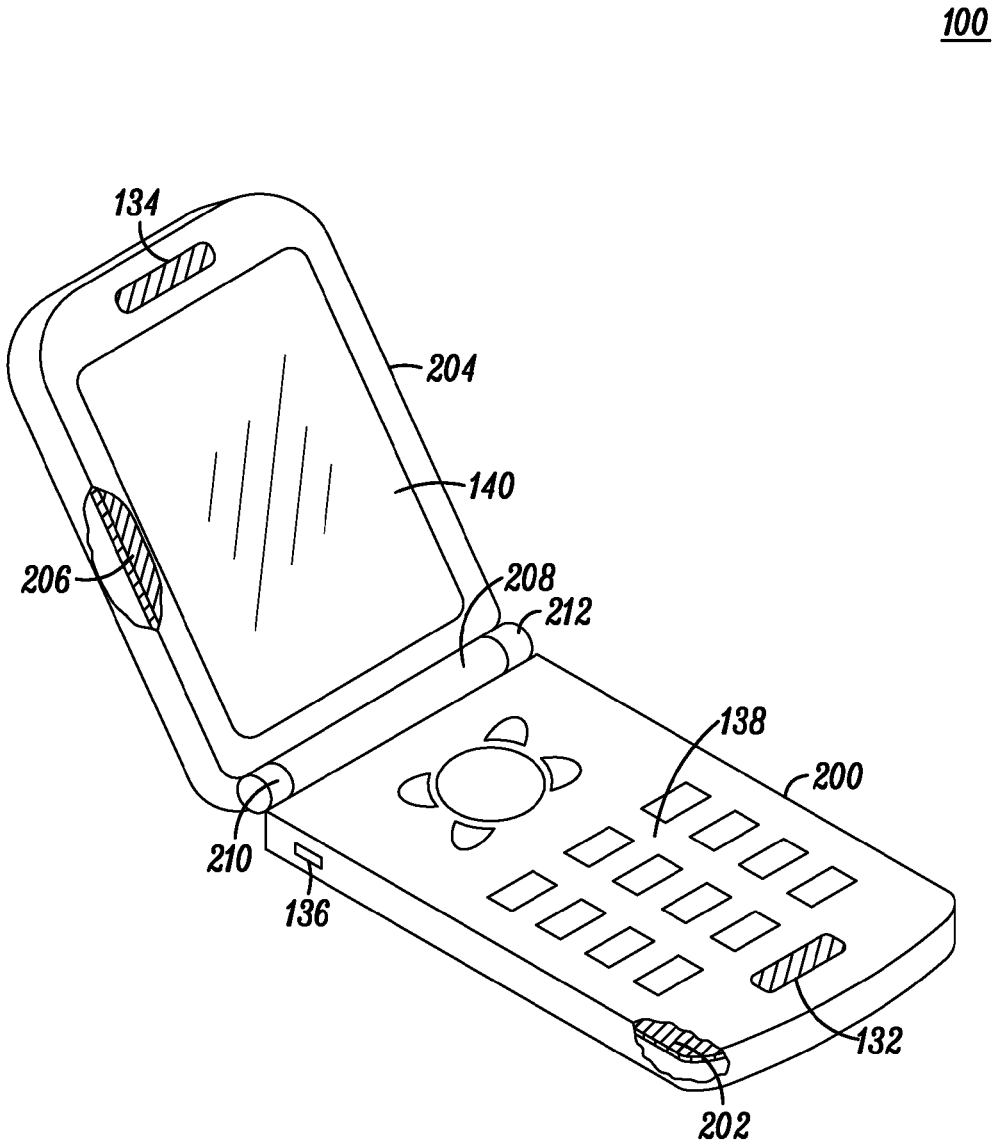
FIG. 2 is a top left front view of the wireless communication device of FIG. 1 in accordance with at least one embodiment of the present invention.

FIG. 2 is a partial cut-away, top left front view of the wireless communication device 100 having a two-part housing in accordance with an embodiment of the present invention. A first housing 200 encloses a first portion 202 of the circuitry of the wireless communication device 100. A second housing 204 encloses a second portion 206 of the circuitry thereof. A hinge 208 between two knuckles 210, 212 couples the first housing 200 to the second housing 202 in a manner well known to those skilled in the art such that the second housing is adapted to rotate relative to the first housing proximate the hinge. While the wireless communication device 100 is depicted in FIG. 2 as having a two-part housing where the first and second housings 200, 204 rotate relative to one another, the wireless communication device 100 could have a two part housing where the first and second housings slide relative to one another or could have a single housing enclosing the circuitry thereof.

The first housing 200 has the microphone 132 mounted therein and a plurality of keys 136, including the keypad 138, mounted thereon. The second housing 204 has the speaker 134 mounted therein and the display 140 mounted thereon.

Figure 3:
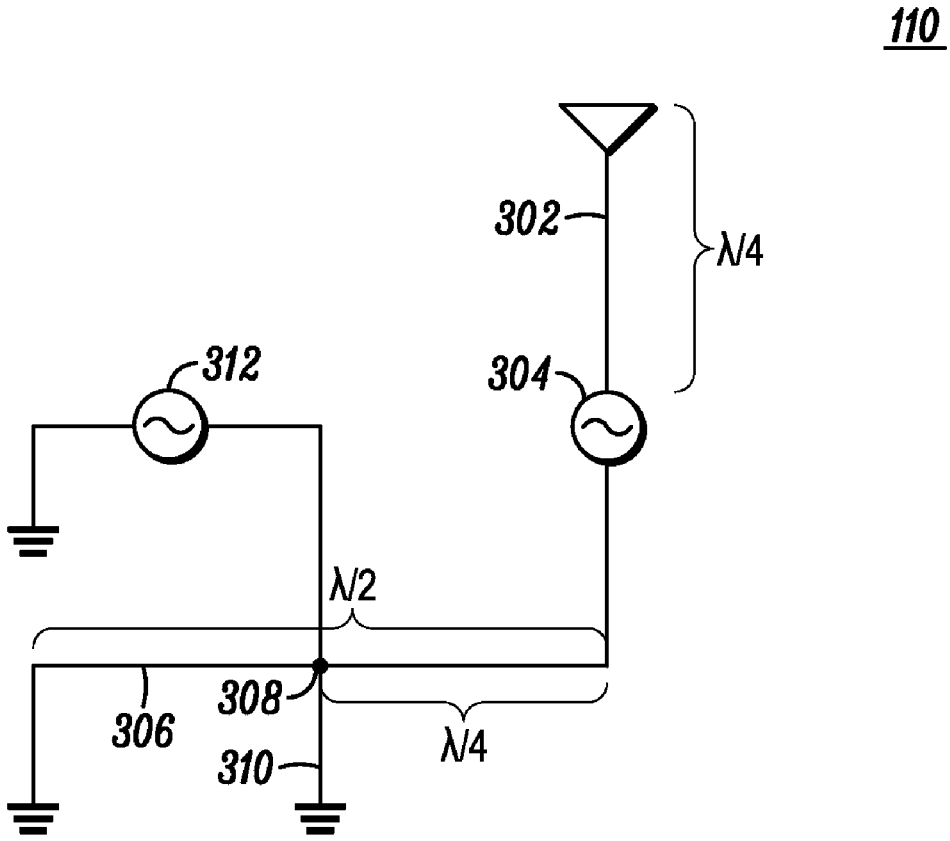
FIG. 3 is a circuit diagram of an antenna system of the wireless communication device of FIG. 1 in accordance with at least one embodiment of the present invention.

Referring to FIG. 3, a circuit diagram of an antenna system 110 in accordance with the embodiment of the present invention includes a primary conductor 302, such as an antenna, which is adapted to receive or radiate electromagnetic energy as RF signals at one or more predetermined frequencies generated by a primary signal generator 304. A ground conductor 306 is located proximate to the primary conductor 302 and may include a ground plane. While the primary conductor 302 is shown coupled to the ground conductor 306, it is understood by those skilled in the art that there is no direct connection; instead the primary conductor 302 is coupled to the ground conductor 306 by a differential feed (not shown). The antenna system 110 is typically tuned such that the ground conductor 306 has a length approximately one-half of the wavelength ($\lambda/2$) of at least one of the predetermined frequencies ($F_1$) and the primary conductor 302 has at least one length (i.e., the primary conductor 302 could be an antenna having multiple electrical lengths for tuning to receive or radiate the predetermined frequencies) which is approximately one-fourth of the wavelength ($\lambda/4$) of the same one of the predetermined frequencies ($F_1$).

In operation, the antenna system 300 receives or radiates electromagnetic energy at a predetermined frequency. The efficiency of the reception or radiation in the electromagnetic energy depends, in part, on the stability of a defined quarter wavelength length on the ground conductor 306. In addition, it is common that an area of more focused current densities or area of higher current densities 308 occurs around the location on the ground conductor 306 about one quarter wavelength down the length thereof (i.e., about halfway down the ground conductor 306), the area of higher current densities 308 causing a reduction in the efficiency of the antenna system 300.

In accordance with an embodiment of the present invention, a secondary conductor 310 has a first end thereof which is coupled to the ground conductor 306 proximate to the area of higher current densities 308 to provide an additional path for localized ground currents thereof. More specifically, a first end of the secondary conductor 310 is coupled to the ground conductor 306 approximately one-quarter wavelength of the one or more of the predetermined frequencies generating the area of higher current densities 308 as measured from the connection of the primary conductor 302 and the ground conductor 306. The secondary conductor 310 splits the effective ground plane of the ground conductor 306 to divert ground currents through an alternative path, defocusing and diverting the ground currents away from the area of higher current densities 308, thereby reducing the higher current densities at area 308 (i.e., altering the direction and/or locations of the currents thereof). In this manner, the secondary conductor 310 advantageously increases the radiation efficiency of the antenna system 110.

Additionally, in accordance with the present invention, the secondary conductor 310 is advantageously adapted to also receive or radiate electromagnetic energy at a second set of predetermined frequencies different than the predetermined frequencies that the primary conductor 302 receives or radiates RF signals. In other words, the secondary conductor 310 is connected to a second signal generator 312 for functioning as a second antenna to receive or radiate RF signals at one of a second set of predetermined frequencies, the length of the secondary conductor 310 being approximately equal to one-quarter wavelength of one or more of the second set of predetermined frequencies.

Loss and interference between the primary conductor 302 and the secondary conductor 310 can be reduced by filtering the load connected to the secondary conductor 310. The form of the secondary conductor can also dictate the connection between the secondary conductor 310 and the ground conductor 308. The secondary conductor 310 could have the form of an inverted-F antenna, a planar inverted-F antenna (PIFA) or an L antenna. If the secondary conductor 310 has the form of an L antenna, the coupling with the ground conductor 306 may include a shunt inductor having a value less than 5 nanoHenrys. If the secondary conductor 310 has the form of an inverted-F or PIFA antenna, the coupling with the ground conductor 306 may include a tuned transmission line.

Figure 4:
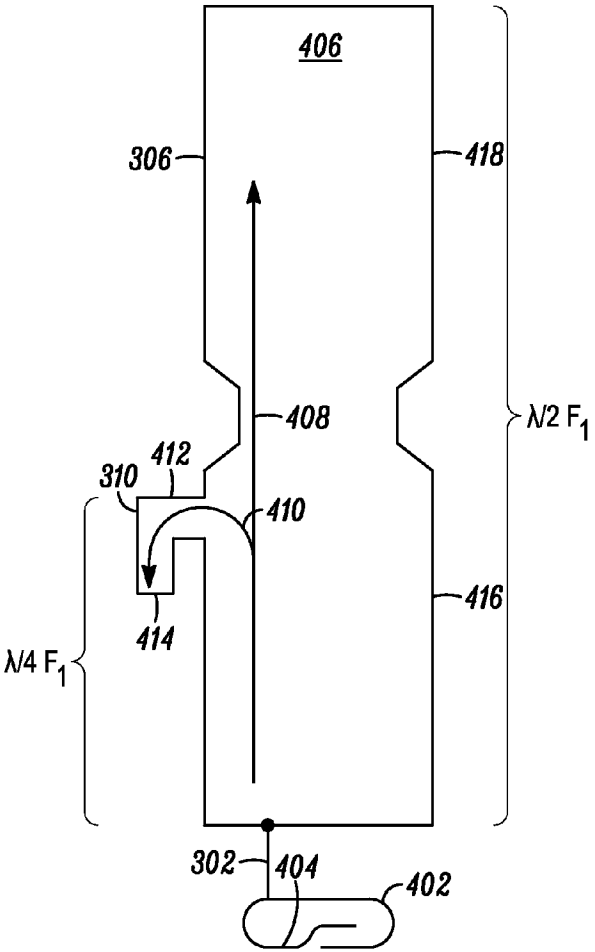
FIG. 4 is a diagram of an antenna system of the wireless communication device of FIG. 1 in accordance with at least one embodiment of the present invention.

FIG. 4 is a diagram of the antenna system 110 in accordance with an embodiment of the present invention. The primary conductor 302, includes a first antenna arm 402 for receiving or radiating electromagnetic energy at one or more first predefined frequencies and a second antenna arm 404 for receiving or radiating electromagnetic energy at one or more second predefined frequencies. A ground conductor 306 is located proximate to one end of the primary conductor 302 and forms an effective ground plane 406. A secondary conductor 310 has a first end thereof which is coupled to the ground plane 406. The antenna arms 402, 404 of the primary conductor 302 have electrical lengths which are approximately one-quarter wavelength of one of the predefined frequencies to which the antenna 402 or 404 is tuned. The ground plane 406 has an electrical length which is one-half wavelength of the same one of the predefined frequencies. In the wireless communication device 100, the ground plane 406 would be enclosed in the first and second housings 200, 204 and, as shown in FIG. 4, is narrower at the center of the ground plane for accommodating the hinge 208 through which the ground plane passes, the narrower width due to the widths of the knuckles 210, 212. As discussed in regards to FIG. 3, when receiving or radiating electromagnetic energy at one or more of the predetermined frequencies, an area of more focused current densities is formed on the ground conductor 306 at a location approximately one-quarter wavelength from the point where the primary conductor 302 and the ground conductor 306 are connected.

In accordance with the present invention, the first end of the secondary conductor 310 is coupled to the ground conductor 306 approximately one-quarter wavelength of the one or more of the predetermined frequencies generating the area of more focused current densities as measured from the connection of the primary conductor 302 and the ground conductor 306 to provide an additional path for any localized ground currents thereof. For example, current flows through the ground plane 406 from the primary conductor 302 along the path 408. The secondary conductor 310 provides an additional path 410 for some of the current to flow, thereby splitting the effective ground plane of the ground conductor 302 to divert ground currents through the alternative path 410. Thus, providing the secondary conductor 310 at the edge of the ground plane 406, where current densities are generally higher, approximately one-quarter wavelength down the ground plane 406 functions to defocus and divert the ground currents away from the area of more focused current densities at the one-quarter wavelength mark, thereby reducing the higher current densities at the one-quarter wavelength (i.e., altering the direction and/or locations of the currents thereof).

In addition to current densities being higher at the edges of the ground plane 406, near body effects when objects are placed near the ground plane 406 can focus the currents in the area, affecting the stability of the quarter wavelength or detuning the antenna due to capacitance coupling between the ground plane 406 and the object focusing the currents. The secondary conductor 310, by providing an alternate path for ground currents to flow proximate to the quarter wavelength location, increases the radiation efficiency and tuning of the antenna system 110 and the stability of the quarter wavelength currents, thereby reducing the capacitive effect of objects near the ground plane 406.

In this manner, the secondary conductor 310 advantageously increases the radiation efficiency of the antenna system 110. Additionally, in accordance with the present invention, the secondary conductor 310 is advantageously adapted to also receive or radiate electromagnetic energy at a second set of predetermined frequencies different than the predetermined frequencies that the primary conductor 302 receives or radiates RF signals. In other words, the secondary conductor 310 functions as a second antenna for receiving one of a second set of predetermined frequencies, the length of the secondary conductor 310 being approximately equal to one-quarter wavelength of one or more of the second set of predetermined frequencies. In accordance with the embodiment of the present invention, the secondary conductor 310 has a first portion 412 forming a crossbar and a second portion 414 forming a leg approximately ninety degrees relative to the crossbar. Additionally, the secondary conductor 310, to accommodate the form of the housing 200, 204 or the circuitry therein 202, 206, may include a third portion forming an arc of approximately ninety degrees and connected between the first portion 412 and the second portion 414 of the secondary conductor 310. Also, the secondary conductor 310 may form a planar ground plane orthogonal to the ground plane 406, or the first portion 412 and the second portion 412 may both be planarly oriented orthogonal to the ground plane 406.

Loss and interference between the primary conductor 302 and the secondary conductor 310 can be reduced by filtering the load connected to the secondary conductor 310. The form of the secondary conductor can also dictate the coupling between the secondary conductor 310 and the ground conductor 306. The secondary conductor 310 could have the form of an inverted-F antenna, a planar inverted-F antenna (PIFA) or an L antenna. If the secondary conductor 310 has the form of an L antenna, the coupling should include a shunt inductor having a value less than 5 nanoHenrys. If the secondary conductor 310 has the form of an inverted-F or PIFA antenna, the coupling should include a tuned transmission line coupling the secondary conductor 410 to the ground conductor 402.

The wireless communication device 100 could be a cellular telephone having a flip-phone form factor such as depicted in FIG. 2. Some such cellular telephones are multi-band phones designed to operate in Global System for Mobile (GSM) communication systems wherein one or more of the predefined frequencies for reception or radiation by the antenna arms 402, 404 of the primary conductor 302 are predefined GSM communication system frequencies. Ergonomically designed flip phone housings 200, 204 can easily accommodate the one-quarter and one-half wavelength dimensions proscribed for the ground plane 406 and the location of the primary and secondary conductors 302, 310 where the first set of predetermined frequencies for reception by or radiation from the primary conductor 302 are GSM communication system frequencies.

Where the ground plane 406 consists of two ground plane portions to fit into the two housing portions 200, 204, such as where the antenna system 110 is implemented in a two-part housing wireless communication device (such as the wireless communication device 100 of FIG. 2), the ground plane has a first portion 416 enclosed in the first housing 200 and a second portion 418 enclosed in the second housing 204. When rotating, sliding or moving the first housing 200 in relation to the second housing 204, the effective ground plane (i.e., the combination of the first and second portions of the ground plane 416, 418) is reduced, thereby possibly reducing the defined quarter wavelength length on the ground plane 406. This leads to reduction and/or de-stabilization of the defined quarter wavelength leading to detuning of the antenna system 110 and loss of efficiency thereof. In addition, as the first and second housings move (e.g., rotate) in relationship to one another, there may be an obstruction between the first and second portions of the ground plane 416, 418, also detuning the antenna system 110 and losing efficiency thereof. In addition to other recited advantages, the secondary conductor 310 will operate to prevent or reduce antenna detuning when the cellular phone is operating in an open flip-phone orientation or in a closed flip-phone orientation.

To achieve a large improvement in antenna system 110 efficiency (as much as sixty percent) in accordance with the present invention, the secondary conductor 310 should be designed to receive or radiate RF signals having the second set of predefined frequencies with wavelengths between one-sixth and one-tenth of the wavelength of the one or more of the first set of predefined frequencies which cause the concentrated ground currents at the quarter wavelength position. For GSM cellular phones, the second set of predefined frequencies could be Bluetooth RF frequencies around 2.44 GHz, which might be used to establish wireless communication capabilities between the phone and one or more other devices such as nearby phones or peripherals, for example, for enabling hands-free operation of the cellular phone 100. Alternatively, the second set of predefined frequencies could be frequencies for receiving RF signals such as Global Positioning System (GPS) signals, Assisted GPS (AGPS) signals, Wireless Local Area Network (WLAN) (such as WiFi signals) or Universal Mobile Telecommunications System (UTMS) signals.

Figure 5:
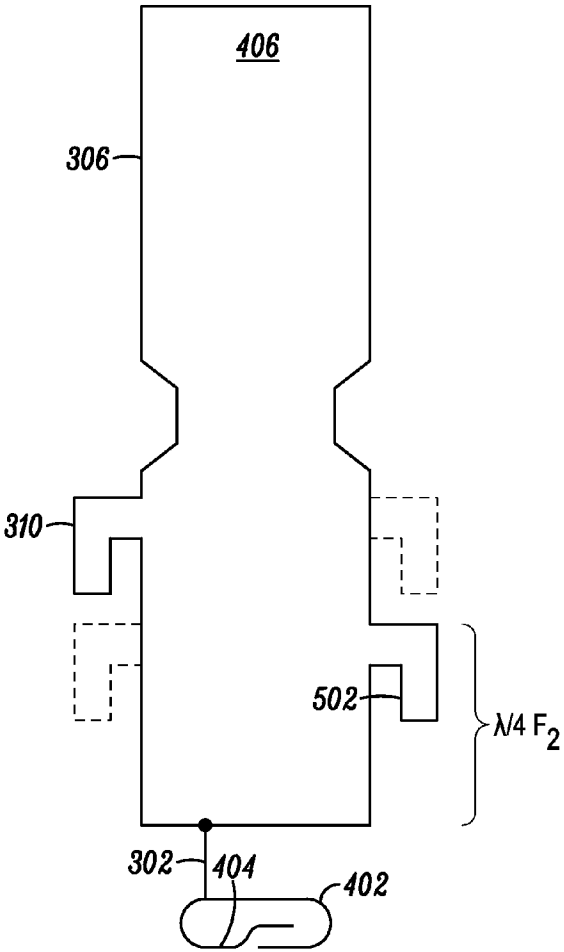
FIG. 5 is a diagram of an antenna system of the wireless communication device of FIG. 1 in accordance with a first alternate embodiment of the present invention.

Referring to FIG. 5, an alternate embodiment of the present invention includes the primary conductor 302, including antenna arms 402, 404, and the secondary conductor 310 coupled to the ground plane 406. The secondary conductor 310 is in at least some instances coupled to the ground conductor by a transmission line. In communication systems such as the GSM communication system, there can be one or more predefined RF signal frequencies within the first set of predefined frequencies that focus current densities in at least two locations on the effective ground plane 406 of the ground conductor 306. In accordance with the present invention, a second secondary conductor 502 could be connected to the ground conductor 306 at a location approximately one-quarter of the wavelength of a second one of the predefined frequencies to increase radiation efficiency by reducing ground currents around that location. For example, 850 MHz and 900 MHz are GSM operational frequencies which could have first and second areas of higher current densities, respectively, formed on the effective ground plane 406 of the ground conductor 306 when signals on these frequencies are radiated or received. The first secondary conductor 310 could be connected to the ground conductor 306 at a location designed to reduce ground currents at a quarter wavelength ($\lambda/4$) location of the first frequency ($F_1$) and the second secondary conductor 502 could be connected to the ground conductor 306 at a location designed to reduce ground currents at a quarter wavelength ($\lambda/4$) location of the second frequency ($F_2$). As noted by the dotted line representations of alternative locations for coupling secondary conductors 310, 502 to the ground conductor 306, which side of the ground plane the secondary conductors 310, 502 are coupled is not important to the invention and any variation of the secondary conductor locations is in accordance with the embodiment of the present invention.

Figure 6:
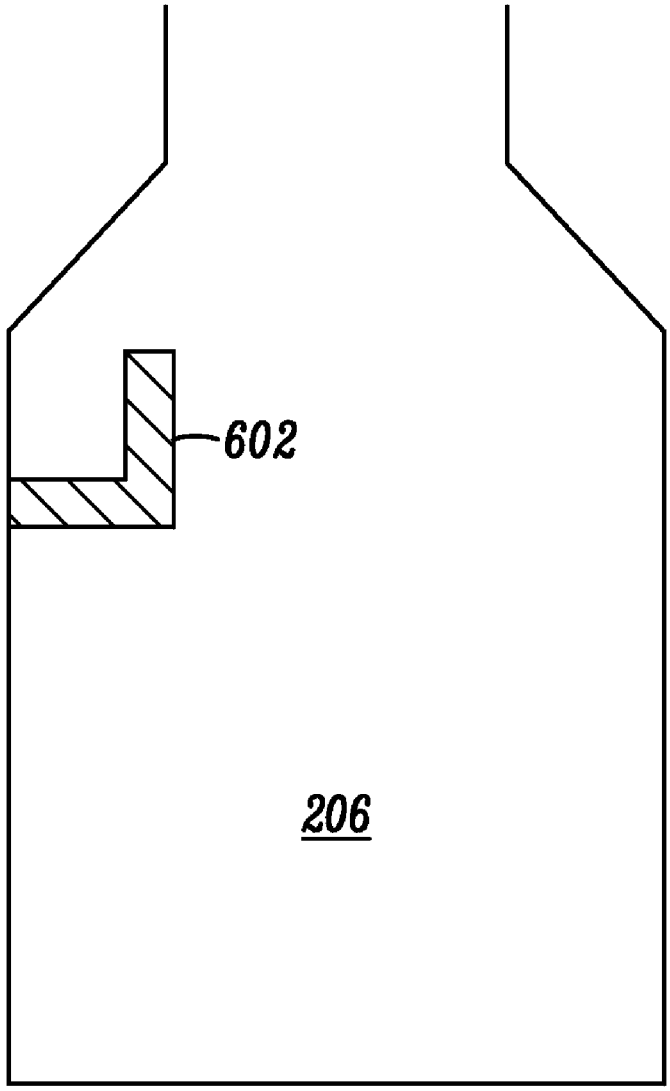
FIG. 6 is a diagram of an antenna system of the wireless communication device of FIG. 1 in accordance with a second alternate embodiment of the present invention.

Referring to FIG. 6, an alternate embodiment of the present invention could have the secondary conductor 602 be a trace created on a printed circuit board of the electronic circuitry 202, 206 which would allow alternative current path.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. An antenna system comprising:

a primary conductor adapted for receiving or radiating electromagnetic energy at a first set of one or more predetermined frequencies of operation;

a ground conductor located proximate at least one end of the primary conductor; and one or more secondary conductors, each secondary conductor having a first end coupled to the ground conductor proximate an area of higher current densities when the primary conductor is receiving or radiating electromagnetic energy at at least a respective one of the first set of one or more predetermined frequencies of operation, wherein the one or more secondary conductors have at least a first mode of operation which provides an additional path for localized ground currents in the ground conductor proximate the area of higher current densities at the respective one of the first set of one or more predetermined frequencies of operation.

2. An antenna system in accordance with claim 1, wherein the primary conductor has at least a first electrical length which is approximately one quarter of the wavelength of at least one of the first set of one or more predetermined frequencies of operation.

3. An antenna system in accordance with claim 2, wherein the ground conductor has an electrical length which is approximately one half of the wavelength of the at least one of the first set of one or more predetermined frequencies of operation, and wherein the area of higher current densities is approximately one quarter of the wavelength of the at least one of the first set of one or more predetermined frequencies of operation along the length of the ground conductor from an end of the ground conductor located proximate the at least one end of the primary conductor.

4. An antenna system in accordance with claim 1, wherein the one or more secondary conductors are coupled to the ground conductor at an approximate position, which is a predetermined distance from the portion of the ground conductor most proximate the at least one end of the primary conductor, that corresponds to an electrical length of the ground conductor which is one quarter of the wavelength of at least the respective one of the first set of one or more predetermined frequencies of operation.

5. An antenna system in accordance with claim 1, wherein the one or more secondary conductors additionally have a second mode of operation in which at least a respective one of the one or more secondary conductors is adapted for receiving or radiating electromagnetic energy at a second set of one or more predetermined frequencies of operation, wherein the second set of one or more predetermined frequencies of operation is different than the first set of one or more predetermined frequencies of operation.

6. An antenna system in accordance with claim 5, wherein the at least one of the one or more secondary conductors has an electrical length which is approximately one quarter of the wavelength of at least one predetermined frequency from the second set of one or more predetermined frequencies of operation.

7. An antenna system in accordance with claim 5, wherein the second set of one or more predetermined frequencies of operation include frequencies for receiving radio frequency (RF) signals in accordance with one of the set of protocols including Bluetooth signals, Global Positioning System (GPS) signals, Assisted GPS (AGPS) signals, Wireless Local Area Network (WLAN) signals and Universal Mobile Telecommunications System (UMTS) signals.

8. An antenna system in accordance with claim 5, wherein the at least one of the one or more secondary conductors comprises one of the set of an inverted-F antenna, a planar inverted-F antenna and an L antenna.

9. An antenna system in accordance with claim 8, wherein the at least one of the one or more secondary conductors comprises an inverted-F antenna, and wherein the antenna system further comprises a tuned transmission line connecting the at least one of the one or more secondary conductors to the ground conductor.

10. An antenna system in accordance with claim 8, wherein the at least one of the one or more secondary conductors comprises an L antenna, and wherein the antenna system further comprises a shunt inductor coupled between the at least one of the one or more secondary conductors and the ground conductor.

11. The antenna system of claim 8 wherein the at least one of the one or more secondary conductors has a first portion forming a crossbar and a second portion forming a leg approximately ninety degrees relative to the crossbar.

12. The antenna system of claim 11 wherein the ground conductor is planar and has a ground conductor major plane thereof, and wherein the first portion and the second portion of the at least one of the one or more secondary conductors are both planarly oriented orthogonal to the ground conductor major plane.

13. The antenna system of claim 11 wherein the at least one of the one or more secondary conductors further comprises a third portion forming an arc of approximately ninety degrees and connected between the first portion and the second portion of the at least one of the one or more secondary conductors.

14. An antenna system in accordance with claim 1, wherein the ground conductor includes at least one ground plane and the one or more secondary conductors are coupled to the ground conductor at an edge of the at least one ground plane.

15. An antenna system in accordance with claim 1, wherein the ground conductor is subdivided into a plurality of electrically coupled ground planes.

16. An antenna system in accordance with claim 1, wherein the first set of one or more predetermined frequencies of operation comprise Global System for Mobile communications (GSM) signaling frequencies.

17. An antenna system comprising:

a primary conductor adapted for receiving or radiating electromagnetic energy at a first set of one or more predetermined frequencies of operation;

a ground conductor located proximate at least one end of the primary conductor and subdivided into a plurality of electrically coupled ground planes, wherein the plurality of electrically coupled ground planes includes at least a pair of ground planes, and wherein a first one of the pair of ground planes is located in a first housing of a wireless communication device having a two part housing and a second one of the pair of ground planes is located in a second housing of the wireless communication device; and one or more secondary conductors, each secondary conductor having a first end coupled to the ground conductor proximate an area of higher current densities when the primary conductor is receiving or radiating electromagnetic energy at at least a respective one of the first set of one or more predetermined frequencies of operation, wherein the one or more secondary conductors have at least a first mode of operation which provides an additional path for localized ground currents in the ground conductor proximate the area of higher current densities at the respective one of the first set of one or more predetermined frequencies of operation.

18. An antenna system in accordance with claim 17, wherein the first housing and second housing slide relative to one another.

19. An antenna system in accordance with claim 17, wherein the first housing and second housing are coupled together via a hinge, and wherein the first housing and the second housing are adapted to rotate relative to one another proximate the hinge.

20. A wireless communication device comprising:

an antenna system comprising:

a primary conductor adapted for receiving or radiating electromagnetic energy at a first set of one or more predetermined frequencies of operation;

a ground conductor located proximate at least one end of the primary conductor; and one or more secondary conductors, each of the one or more secondary conductors having a first end coupled to the ground conductor proximate an area of higher current densities when the primary conductor is receiving or radiating electromagnetic energy at at least a respective one of the first set of one or more predetermined frequencies of operation, wherein the one or more secondary conductors have at least a first mode of operation which provides an additional path for any localized ground currents in the ground conductor proximate the area of higher current densities at the respective one of the first set of one or more predetermined frequencies of operation; and at least one of a first transmitter or first receiver coupled to the primary conductor and the ground conductor for producing or receiving, respectively, signals having a frequency in the at least the respective one of the first set of one or more predetermined frequencies of operation.

21. A wireless communication device in accordance with claim 20, further comprising at least one of a second transmitter or second receiver coupled to the primary conductor and the ground conductor.

22. A wireless communication device in accordance with claim 21, wherein the one or more secondary conductors additionally have a second mode of operation in which at least a respective one of the one or more secondary conductors is adapted for receiving or radiating electromagnetic energy at a second set of one or more predetermined frequencies of operation different than the first set of one or more predetermined frequencies of operation, and wherein the at least one of a second transmitter or second receiver produces or receives, respectively, signals having a frequency in the second set of one or more predetermined frequencies of operation.

23. A wireless communication device in accordance with claim 20, further comprising:

a first housing; and a second housing, wherein the ground conductor is subdivided into two or more electrically coupled ground planes, and wherein a first one of the two or more ground planes is located in the first housing and a second one of the two or more ground planes is located in the second housing.

24. A wireless communication device in accordance with claim 23, further comprising a hinge for coupling the first housing to the second housing, wherein the first housing and the second housing are adapted to rotate relative to one another proximate the hinge.

25. A wireless communication device in accordance with claim 23, wherein the first housing and the second housing slide relative to one another.

26. A wireless communication device in accordance with claim 23, wherein the first one of the two or more ground planes has a first major plane, and wherein the second one of the two or more ground planes has a second major plane, the first major plane parallel to the second major plane, and wherein the one or more secondary conductors have a major plane thereof orthogonal to the first and second major planes.

* * * * *